US009153370B2

(12) United States Patent
Uchida

(10) Patent No.: US 9,153,370 B2
(45) Date of Patent: Oct. 6, 2015

(54) LINEAR SOLENOID

(71) Applicant: DENSO CORPORATION, Kariya, Aichi-pref. (JP)

(72) Inventor: Kimio Uchida, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/313,328

(22) Filed: Jun. 24, 2014

(65) Prior Publication Data

US 2014/0375402 A1 Dec. 25, 2014

(30) Foreign Application Priority Data

Jun. 24, 2013 (JP) ..... 2013-131470

(51) Int. Cl.

| | |
|---|---|
| ***H01H 67/02*** | (2006.01) |
| ***H01F 7/16*** | (2006.01) |
| ***H01F 7/08*** | (2006.01) |
| *H01F 7/18* | (2006.01) |

(52) U.S. Cl.

CPC ..... *H01F 7/1607* (2013.01); *H01F 7/088* (2013.01); *H01F 2007/1692* (2013.01); *H01F 2007/1894* (2013.01)

(58) Field of Classification Search

CPC ..... H01H 50/00; H01H 50/16
USPC ..... 335/126
See application file for complete search history.

(56) References Cited

U.S. PATENT DOCUMENTS

| | | | | |
|---|---|---|---|---|
| 6,968,859 | B1 * | 11/2005 | Nagano et al. | 137/554 |
| 8,193,882 | B2 * | 6/2012 | Murata et al. | 335/126 |
| 2007/0194867 | A1 * | 8/2007 | Kurasawa et al. | 335/126 |
| 2013/0048890 | A1 | 2/2013 | Miura | |
| 2013/0093542 | A1 * | 4/2013 | Sora | 335/192 |

FOREIGN PATENT DOCUMENTS

| | | |
|---|---|---|
| JP | S52-045051 A | 4/1977 |
| JP | S54-109066 U | 1/1979 |
| JP | S59-112910 U | 7/1984 |
| JP | 2010-060074 | 3/2010 |

OTHER PUBLICATIONS

Office Action issued in corresponding Japanese Patent Application No. 2013-131470, mailed on Apr. 27, 2015 (with partial translation).

* cited by examiner

*Primary Examiner* — Shawki S Ismail
*Assistant Examiner* — Lisa Homza
(74) *Attorney, Agent, or Firm* — Nixon & Vanderhye P.C.

(57) ABSTRACT

A linear solenoid has a moving core, a main coil, and a magnetically attractive core. The moving core is supported to be capable of sliding in an axial direction of the moving core. The main coil winds around the moving core and forms a tubular shape. The magnetically attractive core magnetically attracts the moving core based on magnetic force caused by the main coil. The linear solenoid may further have a secondary coil disposed separately from the main coil so that the secondary coil intersects with the moving core at a position corresponding to the secondary coil when the moving core moves toward the magnetically attractive core.

9 Claims, 5 Drawing Sheets

LINEAR SOLENOID

CROSS REFERENCE TO RELATED APPLICATION

This application is based on Japanese Patent Application No. 2013-131470 filed on Jun. 24, 2013, the disclosure of which is incorporated herein by reference in its entirety.

TECHNICAL FIELD

The present disclosure relates to a linear solenoid (i.e., an electromagnetic actuator) in which a moving core is magnetically attracted toward a magnetically attractive core when an exciting coil is energized.

BACKGROUND

Conventionally, a linear solenoid is known, for example, to be used for an electromagnetic valve (see JP 2013-047554 A corresponding to US 2013/0048890 A1). Such conventional linear solenoid has a moving core, an exciting coil, and a magnetically attractive core. The moving core is supported to be capable of sliding in an axial direction of the moving core. The exciting coil winds spirally around the moving core. The magnetically attractive core magnetically attracts the moving core based on magnetic force provided by the exciting coil.

When the exciting coil is energized, the magnetically attractive core magnetically attracts the moving core. By attracting the moving core, a movable member such as the moving core and a valve moved by the moving core hits a fixed member such as a stopper and a valve seat, and a hitting noise such as an operation noise (e.g., a clicking noise) is caused. The hitting noise may be worrisome or annoying for a person. Therefore, the hitting noise due to an operation of the linear solenoid is required to decrease.

SUMMARY

The present disclosure addresses the above issue, and it is an objective of the present disclosure to provide a linear solenoid with which to reduce a hitting noise caused by energizing of an exciting coil.

According to the present disclosure, a linear solenoid has a moving core, a main coil, a magnetically attractive core. The moving core is supported to be capable of sliding in an axial direction of the moving core. The main coil winds around the moving core and forms a tubular shape. The magnetically attractive core magnetically attracts the moving core based on magnetic force caused by the main coil. The linear solenoid may further have a secondary coil disposed separately from the main coil so that a virtual line extending in a radial direction of the secondary coil intersects with the moving core at a position corresponding to the secondary coil when the moving core moves toward the magnetically attractive core.

In the linear solenoid of the present disclosure, when the moving core moves, the moving speed of the moving core is controlled to decrease based on a generating range and a generating electric energy of the counter electromotive force caused at the main coil and the secondary coil. Accordingly, by controlling the counter electromotive force as required, the moving speed of the moving core can be controlled, and the hitting noise due to an operation of the linear solenoid can be reduced.

Alternatively, according to the linear solenoid of the present disclosure, the magnetically attractive core may magnetically attract the moving core based on magnetic force caused by the main coil so that the moving core comes into the main coil. The moving core is controlled in moving speed by controlling a counter electromotive force caused at the main coil based on a number of spiral curves of the main coil.

Alternatively, according to the linear solenoid of the present disclosure, the magnetically attractive core may magnetically attract the moving core based on magnetic force caused by the main coil so that the moving core comes into the main coil. The moving core is controlled in moving speed by changing a number of spiral curves of the main coil in the axial direction so as to control a counter electromotive force caused at the main coil.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION (Embodiment)

An embodiment of the present disclosure will be described referring to drawings. The embodiment is just a specific example, and it should be noted that the present disclosure is not limited to the embodiment.

Although an objective actuated by a linear solenoid is not limited, for example, the linear solenoid is combined with a valve and provides an electromagnetic valve. The electromagnetic valve functions, for example, to switch a passage used for a fuel vapor processing device or a fuel vapor transpiration preventing device mounted in a vehicle or to open or close the passage. However, a usage of the electromagnetic valve is not limited to such an example. Left and right in direction are defined as left side and right side in FIG. 1A, respectively, in the following description. However, it should be noted that the left and right are used for descriptive purpose only and should not limit of actual mounting directions.

Figure 1A:
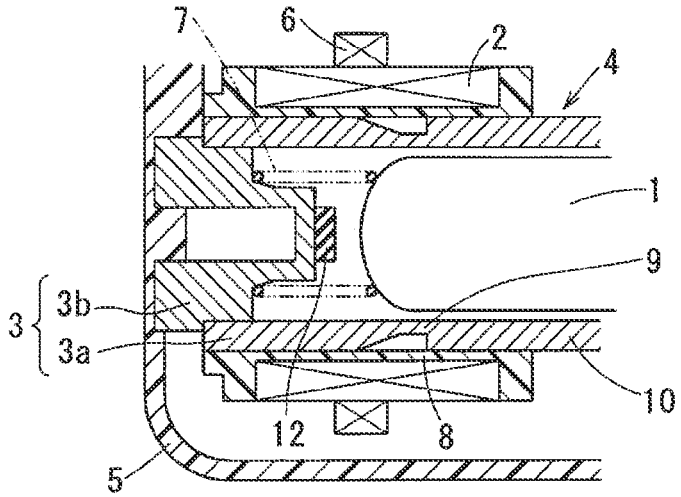
FIG. 1A is a schematic cross-sectional view illustrating a linear solenoid according to an embodiment.

As shown in FIG. 1A, the linear solenoid has a moving core 1, a main coil 2, a stator core 4, a yoke 5, and a secondary coil 6. The main coil 2 and the secondary coil 6 may be referred as an exciting coil and a dummy coil, respectively. The moving core 1 is supported to be capable of sliding in an axial direction of the moving core 1. The main coil 2 winds spirally around the moving core 1 to have a tubular shape. The stator core 4 has a magnetically attractive core 3 magnetically attracting the moving core 1 based on magnetic force caused by the main coil 2. The yoke 5 provides a magnetic path at outside the main coil 2. The secondary coil 6 is located to cross with the moving core 1 in the axial direction of the moving core, in other words, the moving core 1 slides inside of the secondary coil 6 at least partly.

The moving core 1 is made of a magnetic material (e.g., a ferromagnetic material such as iron) and formed generally in a cylindrical shape, in other words, an outer periphery of the moving core 1 provides a surface of the cylindrical shape. The moving core 1 is supported inside the stator core 4 to be capable of sliding in the axial direction (i.e., a left-right direction) and slides in the axial direction (i.e., leftward) based on magnetic force caused by the main coil 2.

The moving core 1 is biased rightward due to biasing force caused by a return spring 7 interposed between the moving core 1 and the stator core 4. Accordingly, when the main coil 2 is not energized, the moving core 1 moves rightward due to the biasing force caused by the return spring 7, and a valve (i.e., a valve body) (not shown) also moves rightward.

When current is applied to the main coil 2, the main coil 2 causes magnetic force. The main coil 2 is formed in a manner that a conducting wire (e.g., an enameled wire) applied of insulation coating winds to form spiral curves around a bobbin 8 made of plastic material. Specifically, the bobbin 8, around which the main coil 2 is provided, is disposed to fit to outside of the stator core 4. When the main coil 2 is energized, and when the moving core 1 moves leftward from a stopping position, a part of the moving core 1 located inside the main coil 2 increases.

The stator core 4 is made of a magnetic material (e.g., a ferromagnetic material such as iron). The stator core 4 is attracted to and coupled with the yoke 5 due to magnetic force. The stator core 4 having the magnetically attractive core 3 further has a magnetism interception part 9 and a magnetism delivery core 10.

The magnetically attractive core 3 magnetically attracts the moving core 1 leftward due to magnetic force caused by the main coil 2. A magnetism attracting part (i.e., a main clearance) is provided between the magnetically attractive core 3 and the moving core 1 in the axial direction. The magnetically attractive core 3 of the present embodiment includes a cylindrical portion 3*a* located inside the bobbin 8 and a bottom portion 3*b* opposing to the moving core 1 in the axial direction, and the cylindrical portion 3*a* and the bottom portion 3*b* are configured separately from each other. However, the magnetically attractive core 3 is not limited to have such a configuration.

The magnetism interception part 9 is a magnetic saturation part and intercepts a magnetic flux from being delivered directly between the magnetically attractive core 3 and the magnetism delivery core 10. The magnetism interception part 9 is thin in a thickness direction with respect to the cylindrical portion 3*a* of the magnetically attractive core 3 and the magnetic delivery core 10. Accordingly, the magnetism interception part 9 has a large magnetic resistance with respect to the cylindrical portion 3*a* and the magnetic delivery core 10.

The magnetism delivery core 10 delivers a magnetic flux between the moving core 1 and the magnetism delivery core 10 in a radial direction of the moving core 1. A magnetism delivery part (i.e., a side magnetic clearance) is provided between the magnetism delivery core 10 and the moving core 1 in the radial direction. The magnetism delivery core 10 includes a flange (not shown) extending outward in the radial direction, and the flange is attracted to and coupled with the yoke 5 due to magnetic force.

The yoke 5 is made of a magnetic material (i.e., a ferromagnetic material such as iron) and provides a magnetic path at an outer side of the main coil 2. The yoke 5 is formed in a bottomed shape such as a generally U-shape and a cup-shape. Components configuring the linear solenoid are disposed inside the yoke 5, and a resin molding is applied to the yoke 5.

Figure 1B:
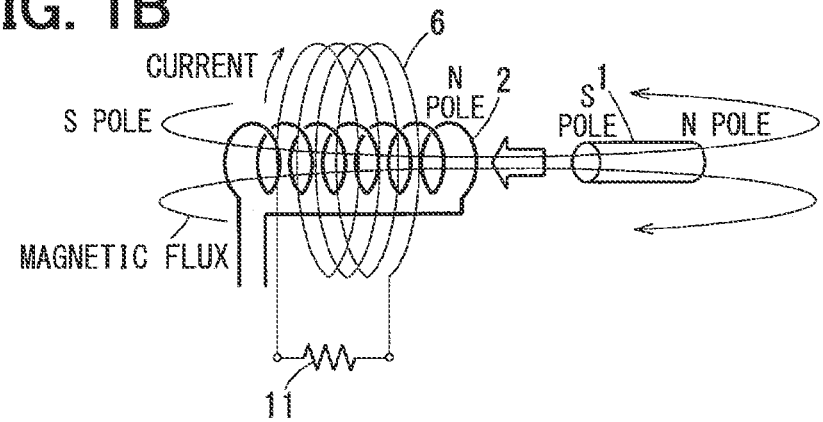
FIG. 1B is an explanatory view illustrating how a moving core is attracted to a main coil.

The secondary coil 6 is disposed separately from the main coil 2 and located so that the moving core 1 moves at least partly in an inner side of the secondary coil 6 in the axial direction. In other words, the secondary coil 6 is located so that a virtual line extending in a radial direction of the secondary coil 6 intersects with the moving core 1 at a position corresponding to the secondary coil 6, when the moving core 1 moves toward the magnetically attractive core 3. For a specific example, the secondary coil 6 of the present embodiment is formed in a manner that a conducting wire (e.g., an enameled wire) applied of insulation coating spirally winds around the main coil 2 or the like to form a predetermined number of spiral curves. As shown in FIG. 1B, both end tips of the secondary coil 6 are shorted out through a resistive element 11. That is, a resistance value of the secondary coil 6 is set by using the resistive element 11.

Operation Examples of Moving Core 1

(Without Using Secondary Coil 6)

Figure 2A:
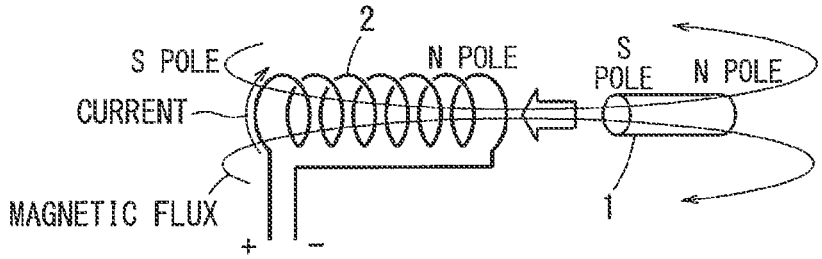
FIG. 2A is an explanatory view illustrating the moving core and the main coil at a time when current starts flowing through the main coil to attract the moving core.
Figure 2B:
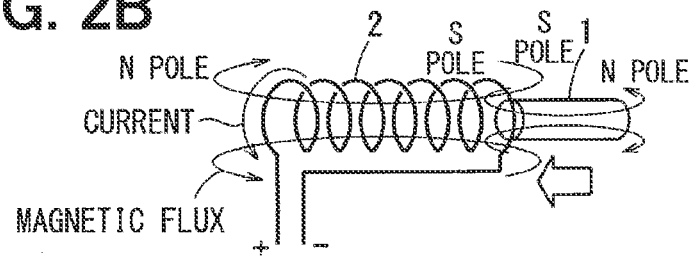
FIG. 2B is an explanatory view illustrating a state where a counter electromotive force is caused.
Figure 2C:
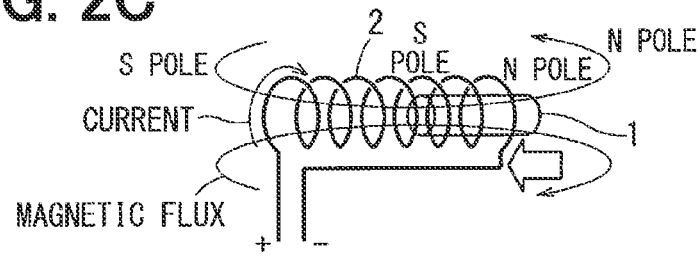
FIG. 2C is an explanatory view illustrating a state where the counter electromotive force decreases, and a moving speed of the moving core increases.
Figure 2D:
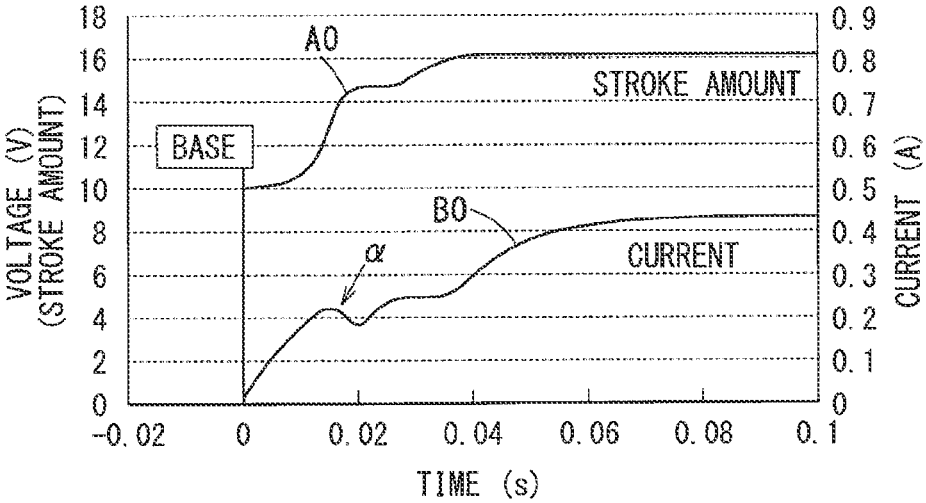
FIG. 2D is a graph showing a relationship among the stroke amount of the moving core with time and the current value at the main coil with time.

An operation of the moving core 1 without using the secondary coil 6 will be described referring to FIG. 2A-2D, as a comparison example with respect to an operation of the moving core 1 using the secondary coil 6. In FIG. 2D, a stroke amount of the moving core 1 is shown with a solid line A0, and a current value at the main coil 2 is shown with a solid line BO, in the operation of the moving core 1 without using the secondary coil 6.

At a base line in FIG. 2D, the main coil 2 is not energized. When the main coil 2 is energized, current rapidly starts flowing through the main coil 2 as shown in FIG. 2A, and the moving core 1 promptly starts moving leftward. When the moving core 1 moves promptly, a first counter electromotive force α is caused at the main coil 2 as shown in FIG. 2B. Subsequently, the main coil 2 causes magnetic force (i.e., a repulsing magnetic field) effecting in a direction preventing a movement of the moving core 1. Accordingly, a moving speed of the moving core 1 decreases. When the moving speed of the moving core 1 decreases, the first counter electromotive force α caused at the main coil 2 reduces, and the moving speed of the moving core 1 increases again, as shown in FIG. 2C.

Therefore, when the moving core 1 hits a stopper 12 in a state where the moving speed of the moving core 1 increases again, a hitting noise is caused.

(Using Secondary Coil 6)

Figure 1C:
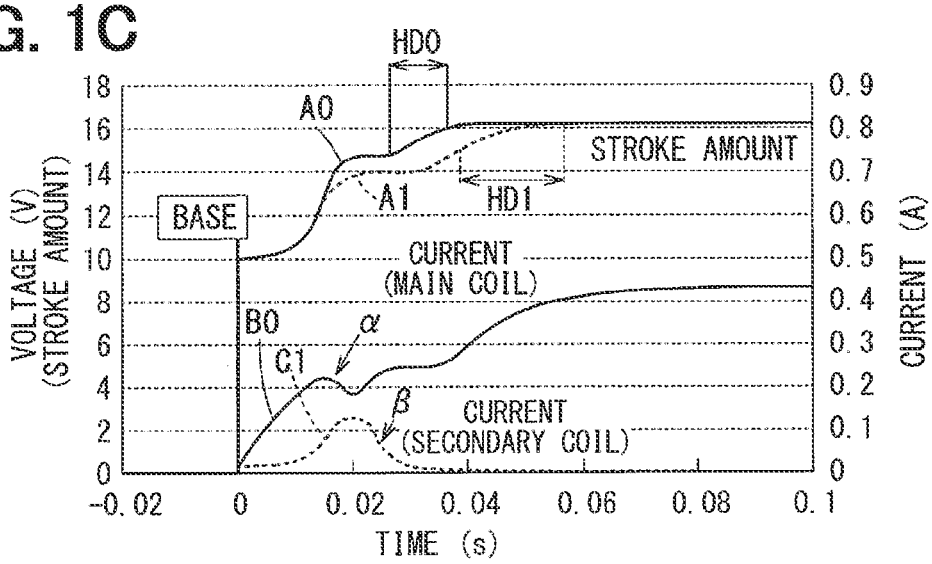
FIG. 1C is a graph showing a relationship among a stroke amount of the moving core with time, a current value at the main coil with time, and a current value at a secondary coil with time.

The operation of the moving core 1 using the secondary coil 6 will be described referring to FIGS. 1A-1C. In FIG. 1C, a stroke amount of the moving core 1 is shown with a dashed line A1, and a current value at the secondary coil 6 is shown with a dashed line C1, in the operation of the moving core 1 using the secondary coil 6. In this case, the secondary coil 6 is located generally at the center of the main coil 2 in the axial direction.

At a base line in FIG. 1C, the main coil 2 is not energized. When the main coil 2 is energized, current rapidly starts flowing through the main coil 2 as shown in FIG. 1C, and the moving core 1 promptly starts moving leftward, as the same as a case of the operation of the moving core 1 without using the secondary coil 6. When the moving core 1 moves at high speed, the first counter electromotive force α is caused at the main coil 2 as the same as the case of the operation of the moving core 1 without using the secondary coil 6. Subsequently, the main coil 2 causes the repulsing magnetic field, and a moving speed of the moving core 1 decreases. When the moving speed of the moving core 1 decreases, the first counter electromotive force α caused at the main coil 2 reduces. Subsequently, a second counter electromotive force β is caused at the secondary coil 6. The secondary coil 6 causes magnetic force (i.e., a repulsing magnetic field) effecting in a direction preventing a movement of the moving core 1, and the moving speed of the moving core 1 decreases. As the result, a hitting duration HD1 can be made long compared with a hitting duration HD0 of the comparison example as shown in FIG. 1C.

Thus, when the second counter electromotive force β is caused at the secondary coil 6 after decreasing of the first counter electromotive force α caused at the main coil 2, the moving speed of the moving core 1 can be restricted from increasing. Therefore, a speed of the moving core 1 at a time of hitting the stopper 12 can be decreased, and the hitting sound can be restricted from causing due to an operation of the linear solenoid.

(Changing Location of Secondary Coil 6)

Figure 3A:
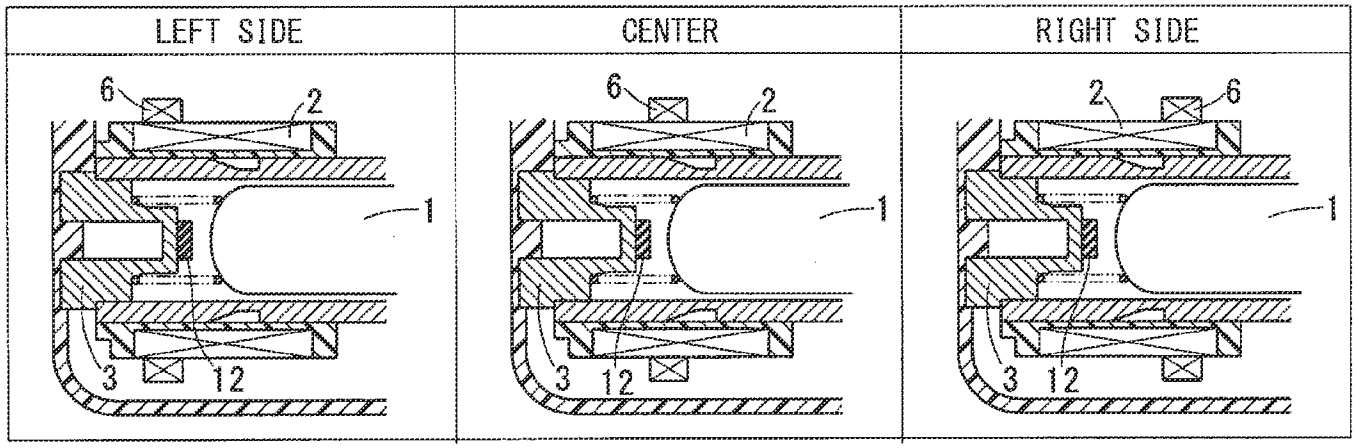
FIG. 3A is a schematic cross-sectional view illustrating examples of a position of the secondary coil.

An example of a control of the moving speed of the moving core 1 by changing a location of the secondary coil 6 in the axial direction will be described referring to FIGS. 3A and 3B.

Figure 3B:
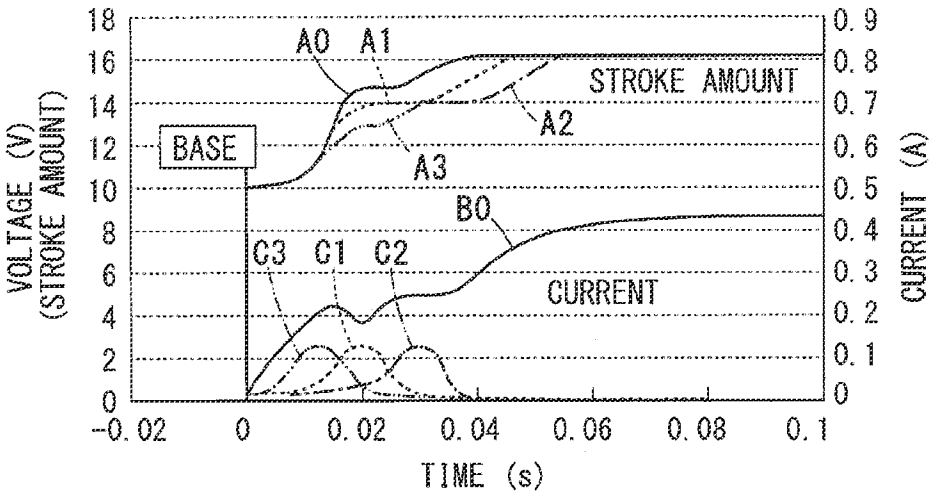
FIG. 3B is a graph showing a relationship among the stroke amount of the moving core with time and the current value at the main coil with time, with respect to each of the examples of the position of the secondary coil.

In FIG. 3B, the stroke amount of the moving core 1 and the current value of the secondary coil 6 in a case where the secondary coil 6 is located generally at the center of the main coil 2 are shown with the dashed line A1 and the dashed line C1, respectively. In FIG. 3B, the stroke amount of the moving core 1 and the current value of the secondary coil 6 in a case where the secondary coil 6 is located at a left side of the main coil 2 are shown with a one-dot chain line A2 and a one-dot chain line C2, respectively. In FIG. 3B, the stroke amount of the moving core 1 and the current value of the secondary coil 6 in a case where the secondary coil 6 is located at a right side of the main coil 2 are shown with a two-dot chain line A3 and a two-dot chain line C3, respectively.

The control of the moving speed of the moving core 1 in the case where the secondary coil 6 is located generally at the center of the main coil 2 is the same as the above description.

In the case where the secondary coil 6 is located at the left side of the main coil 2, the second counter electromotive force β is caused at the secondary coil 6 when the moving core 1 is closer to the stopper 12 with respect to the case where the secondary coil 6 is located generally at the center of the main coil 2. Accordingly, the moving speed of the moving core 1 can decrease when the moving core 1 gets closer to the stopper 12.

When the moving core 1 starts moving in the case where the secondary coil 6 is located at the right side of the main coil 2, the second counter electromotive force β is caused initially with respect to the case where the secondary coil 6 is located generally at the center of the main coil 2. Accordingly, the moving speed of the moving core 1 can decrease initially when the moving core 1 starts moving.

Therefore, by changing a location of the secondary coil 6, a timing of decreasing of the moving speed of the moving core 1 can be controlled as needed.

(Changing Number of Spiral Curves of Secondary Coil 6)

Figure 4A:
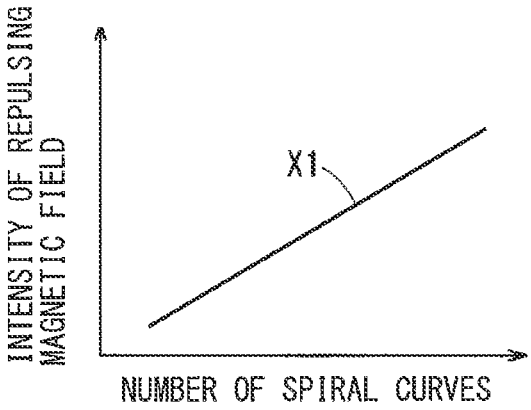
FIG. 4A is a graph showing a relationship between a number of spiral curves of the secondary coil and an intensity of repulsing magnetic field caused by the secondary coil.
Figure 4B:
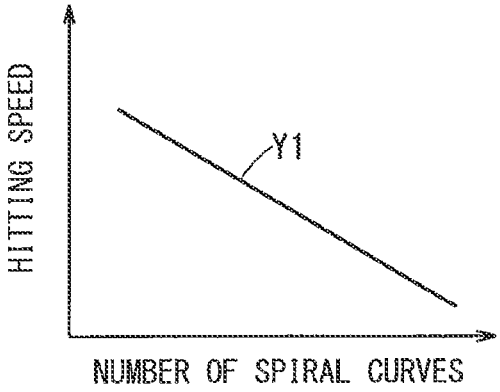
FIG. 4B is a graph showing a relationship between a number of spiral curves of the secondary coil and a hitting speed of the moving core hitting to a stopper.

An example of a control of the moving speed of the moving core 1 by changing the number of spiral curves of the secondary coil 6 will be described referring to FIGS. 4A and 4B.

The larger the number of spiral curves of the secondary coil 6, the larger the second counter electromotive force β caused at the secondary coil 6. As shown with a solid line X1 in FIG. 4A, when the number of spiral curves of the secondary coil 6 increases, intensity of the repulsing magnetic field caused by the secondary coil 6 increases. Accordingly, as shown with a solid line Y1 in FIG. 4B, when the number of spiral curves of the secondary coil 6 increases, the hitting sound caused when the moving core 1 hits the stopper 12 can be reduced.

Therefore, by changing the number of spiral curves of the secondary coil 6, a decreasing range of the moving speed of the moving core 1 can be controlled as needed.

(Changing Resistance Value of Resistive Element 11)

Figure 5A:
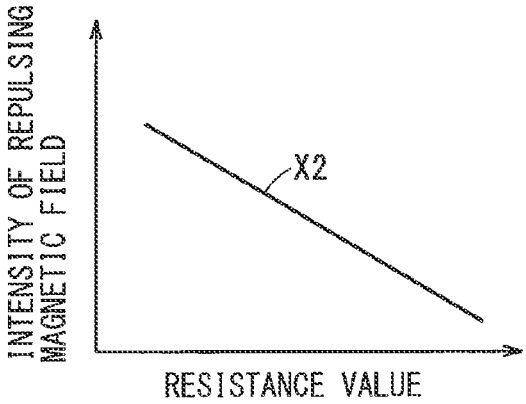
FIG. 5A is a graph showing a relationship between a resistance value of a resistive element and an intensity of repulsing magnetic field caused by the secondary coil.
Figure 5B:
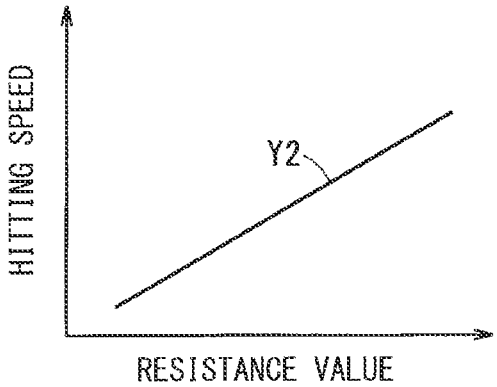
FIG. 5B is a graph showing a relationship between a resistance value and a hitting speed of the moving core.

An example of a control of the moving speed of the moving core 1 by changing the resistance value of the resistive element 11 will be described referring to FIGS. 5A and 5B.

The larger the resistance value of the resistive element 11, the smaller the second counter electromotive force β caused at the secondary coil 6. As shown with a solid line X2 in FIG. 5A, when the resistance value of the resistive element 11 decreases, the intensity of the repulsing magnetic field caused by the secondary coil 6 increases. Accordingly, as shown with a solid line Y2 in FIG. 5B, when the resistance value of the resistive element 11 decreases, the hitting sound caused when the moving core 1 hits the stopper 12 can be reduced.

Therefore, by changing the resistance value of the resistive element 11, a decreasing range of the moving speed of the moving core 1 can be controlled as needed.

(Changing Number of Spiral Curves of Main Coil 2)

An example of a control of a causing amount of the first counter electromotive force α caused at the main coil 2, which is controlled by changing the number of spiral curves of the main coil 2, will be described referring to FIG. 6.

By changing the number of spiral curves of the main coil 2 to control the first counter electromotive force α caused at the main coil 2, the moving speed of the moving core 1 is controlled.

Figure 6:
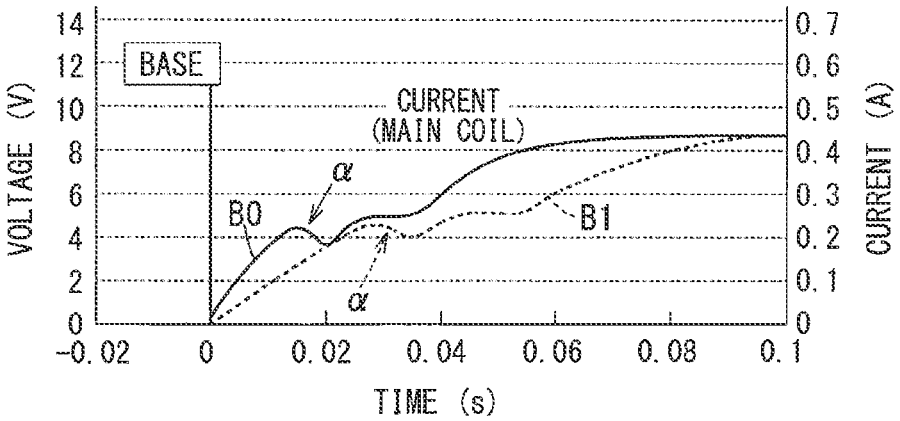
FIG. 6 is a graph showing a relationship between a movement of the moving core according to a variation in the number of spiral curves of the main coil.

Specifically, the smaller the number of spiral curves of the main coil 2, the smaller the first counter electromotive force α caused at the main coil 2, as shown with a dashed line B1 in FIG. 6. Therefore, by changing the number of spiral curves of the main coil 2, the causing amount of the first counter electromotive force α caused at the main coil 2 can be controlled as needed. Accordingly, the moving speed of the moving core 1 can be controlled.

(Changing Form of Spiral Curves of Main Coil 2)

An example of a control of a causing amount of the first counter electromotive force α caused at the main coil 2 by changing a form of spiral curves of the main coil 2 will be described referring to FIGS. 7A-7C.

By changing the number of the spiral curves of the main coil 2 in the axial direction, in other words, by changing the number of the spiral curves of the main coil 2 to be ununiform in the axial direction, the moving speed of the moving core 1 is controlled.

Figure 7A:
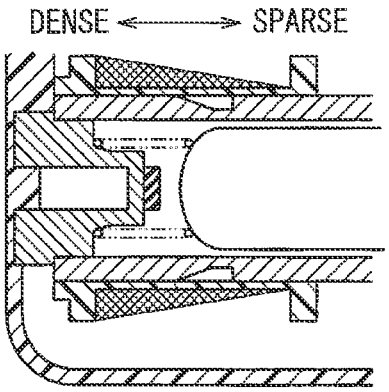
FIG. 7A is a schematic cross-sectional view illustrating a main coil in which the number of spiral curves of the main coil increases from a right side to a left side.
Figure 7B:
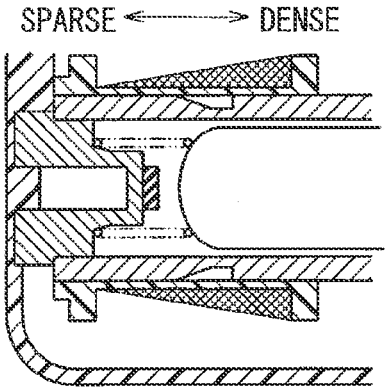
FIG. 7B is a schematic cross-sectional view illustrating a main coil in which the number of spiral curves of the main coil decreases from a right side to a left side.
Figure 7C:
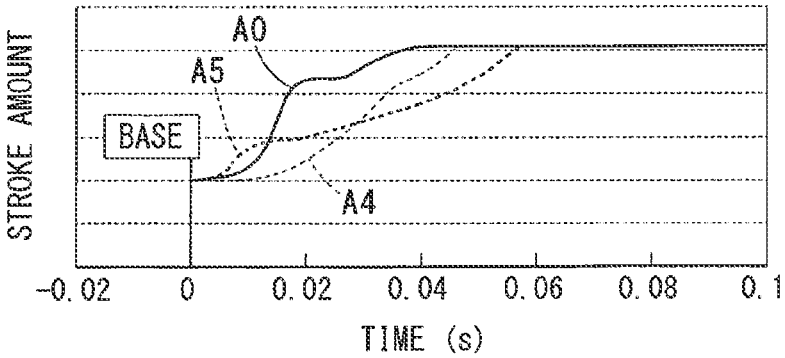
FIG. 7C is a graph showing a relationship among the stroke amount of the moving core with time due to changing the number of spiral curves of the main coil.

Specifically, when the number of the spiral curves of the main coil 2 increases from the right side to the left side as shown in FIG. 7A, in other words, the main coil 2 is more dense at the left side than at the right side, a start speed of the moving core 1 is restricted from rising rapidly as shown by a dashed line A4 in FIG. 7C. The start speed of the moving core 1 is a speed of the moving core 1 at a time of starting moving. In addition, the first counter electromotive force α is caused at the main coil 2 when the moving core 1 comes close to the stopper 12. Accordingly, the moving speed of the moving core 1 is restricted from increasing.

Conversely, when the number of the spiral curve of the main coil 2 decreases from the right side to the left side as shown in FIG. 7B, in other words, the main coil 2 is less dense at the left side than at the right side, the moving speed of the moving core 1 is restricted from increasing as the moving core 1 comes close to the stopper 12 as shown by a dashed line A5 in FIG. 7C. In addition, the first counter electromotive force α is caused initially at the main coil 2 when the moving core 1 starts moving. Accordingly, the moving speed of the moving core 1 is restricted from increasing initially when the moving core 1 starts moving.

Thus, by changing the number of the spiral curves of the main coil 2 in the axial direction, a causing timing of the first counter electromotive force α caused by the main coil 2 can be controlled as needed. Accordingly, the moving speed of the moving core 1 can be controlled.

According to the present embodiment, the present disclosure is adopted to the linear solenoid of the electromagnetic valve for the fuel vapor processing device or the fuel vapor transpiration preventing device. However, the present disclosure may be adopted to a linear solenoid of an electromagnetic valve used for other uses.

According to the present embodiment, the present disclosure is adopted to the linear solenoid for the electromagnetic valve. However, an objective actuated by a linear solenoid is not limited to a valve, and the present disclosure may be adopted to a linear solenoid actuating other objectives except for a valve.

Such changes and modifications are to be understood as being within the scope of the present disclosure as defined by the appended claims.

What is claimed is:

1. A linear solenoid comprising:

a moving core supported to be capable of sliding in an axial direction of the moving core;

a main coil winding around the moving core and forming a tubular shape;

a magnetically attractive core configured to magnetically attract the moving core based on magnetic force caused by the main coil; and a secondary coil disposed separately from the main coil so that the secondary coil intersects with the moving core at a position corresponding to the secondary coil when the moving core moves toward the magnetically attractive core, wherein the magnetically attractive core comprises a cylindrical portion including a magnetism interception part that is thin in a radial direction of the moving core with respect to another portion of the cylindrical portion, and the secondary coil is located generally at a center of the main coil to overlap with the magnetism interception part in the axial direction.

2. The linear solenoid according to claim 1, wherein the moving core is controlled in moving speed by changing a position of the secondary coil in the axial direction.

3. The linear solenoid according to claim 1, wherein the moving core is controlled in moving speed by changing a number of spiral curves of the secondary coil.

4. The linear solenoid according to claim 1, wherein the secondary coil has both end tips which are connected with each other through a resistive element, and the moving core is controlled in moving speed based on a resistance value of the resistive element.

5. The linear solenoid according to claim 1, wherein the magnetically attractive core further comprises a bottom portion, the cylindrical portion further comprises a magnetism delivery core, the magnetism interception part is located between the bottom portion and the magnetism delivery core in the axial direction, the moving core and the magnetism delivery core are adjacent to each other in the radial direction, and a magnetic flux is delivered between the moving core and the magnetism delivery core, and the magnetism interception part intercepts the magnetic flux from being delivered directly to the bottom portion.

6. The linear solenoid according to claim 5, wherein the cylindrical portion and the bottom portion are separate pieces.

7. The linear solenoid according to claim 1, wherein the magnetism interception part has a larger magnetic resistance than other portions of the cylindrical portion.

8. The linear solenoid according to claim 1, wherein the magnetism interception part is axially located between the secondary coil and an axial end of the of the main coil.

9. The linear solenoid according to claim 8, wherein the magnetism interception part is located such that the core radially overlaps the magnetism interception part before the secondary coil as the moving core moves axially into the main coil.

* * * * *